US005312059A

United States Patent [19]

Membrino

[11] Patent Number: 5,312,059

[45] Date of Patent: May 17, 1994

[54] MACHINE FOR REWINDING AND INTERMEDIATELY PROCESSING THIN FLEXIBLE MATERIAL USING A CONVEYOR

[76] Inventor: Hercules Membrino, 280 Paoli State Rd., Malvern, Pa. 19355

[21] Appl. No.: 904,606

[22] Filed: Jun. 26, 1992

[51] Int. Cl.[5] ..... B65H 18/16; B65H 35/02

[52] U.S. Cl. ..... 242/56.2; 242/65

[58] Field of Search ..... 242/65, 66, 56.2, 56.4, 242/56.5, 56.6

Related U.S. Application Data

[63] Continuation-in-part of Ser. No. 779,105, Oct. 18, 1991, U.S. Pat. No. 5,194,062, which is a continuation-in-part of Ser. No. 539,129, Jun. 18, 1990, abandoned.

[56] References Cited

U.S. PATENT DOCUMENTS

| | | | |
|---|---|---|---|
| 1,047,408 | 12/1912 | Hellberg | 242/65 |
| 1,076,189 | 10/1913 | Cameron et al. | 83/506 X |
| 1,256,499 | 2/1918 | Cameron et al. | 242/67.5 |
| 2,157,054 | 5/1939 | Gammeter | 493/203 |
| 2,326,173 | 8/1943 | Russell . | |
| 2,777,644 | 1/1957 | Nicholson | 242/65 |
| 2,936,815 | 5/1960 | Schjeldahl et al. | 493/203 |
| 2,984,427 | 5/1961 | Rockstrom | 242/65 |
| 3,086,577 | 4/1963 | Gimple | 493/199 |
| 3,146,147 | 8/1964 | Naser | 493/202 |
| 3,194,124 | 7/1965 | Warp | 493/197 |
| 3,198,453 | 8/1965 | Aaron | 242/65 |
| 3,378,213 | 4/1968 | Habozit | 242/65 |
| 3,411,419 | 1/1968 | Becker et al. | 493/194 |
| 3,412,636 | 11/1968 | Seiff | 242/56.2 X |
| 3,433,429 | 3/1969 | Schnitzspahn | 242/65 |
| 3,497,129 | 2/1970 | Stein | 493/193 |
| 3,511,435 | 5/1970 | Hewitt et al. | 493/202 |
| 3,552,278 | 1/1971 | Guenther | 493/196 |
| 3,735,673 | 5/1973 | Sheehan et al. | 493/203 |
| 3,783,750 | 1/1974 | Heimeijer | 493/196 |
| 3,850,462 | 11/1974 | Cheetham et al. | 242/65 |
| 4,316,587 | 7/1982 | Gauthier | 242/75.43 |
| 4,634,069 | 1/1987 | Kataoka | 242/65 |
| 4,729,520 | 3/1988 | Kataoka | 242/56.2 |
| 4,747,815 | 5/1988 | Benoit et al. | 493/194 |
| 4,905,927 | 3/1990 | Lesse | 242/75.43 |

FOREIGN PATENT DOCUMENTS

| | | |
|---|---|---|
| 0002429 | of 1979 | European Pat. Off. . |
| 0096984 | of 1983 | European Pat. Off. . |
| 380877 | of 1932 | United Kingdom . |
| 2181118 | of 1987 | United Kingdom . |

OTHER PUBLICATIONS

Weiss, Herbert. "Rewinders." *Technically Speaking.* North American Publishing Company, 1983, pp. 91–94.

Weiss, Herbert. "Print Length Control." *Technically Speaking.* North American Publishing Company, 1983, pp. 86–90.

Wainer, Michael V. "Technology, Performance Keys for Plastic Bagmakers." *Paper, Film & Foil Converter.* Apr. 1990, pp. 75–76.

Weiss, Herbert. "Lay-On Rollers Improve Quality." *Package Printing* Sep. 1984, p. 54.

Kirchner, Richard F. "Roll Winding Techniques Key to Slitting Success." *Paper, Film & Foil Converter.* Sep. 1989, pp. 124–130.

Rienau, John R. "Look At Winding Continues." *Paper, Film & Foil Converter.* Nov. 1989, pp. 92–96.

LeMin, Joseph R. "Top Billing For Slitting From Converting Industry." *Paper, Film & Foil Converter.* Jul. 1989, pp. 72–73.

Lamson, Wade P. "Controlling Web Tension Critical in Center Winders." *Paper, Film & Foil Converter.* Aug. 1989, pp. 160–164.

*Primary Examiner*—John M. Jillions

*Attorney, Agent, or Firm*—Dann, Dorfman, Herrell and Skillman

[57] ABSTRACT

An apparatus and method is provided for processing and rewinding a web made of easily stretchably deformable plastic film. The web is drawn from a supply roll assembly by a series of synchronously, positively driven draw and transfer rolls and directly delivered to a rewind spindle. The rewind spindle is positively driven at a speed greater than the speed imparted to the web by the draw and transfer rolls. However, the rewind spindle is in peripheral contact with a transfer drum which is the last of the series of draw and transfer rolls so that the processed web is immediately transferred from the transfer drum to the rewind spindle. The transfer drum exerts a drag on the rewind spindle to control and match the speed of the rewind spindle to the speed of the moving web.

34 Claims, 10 Drawing Sheets

FIG. 6
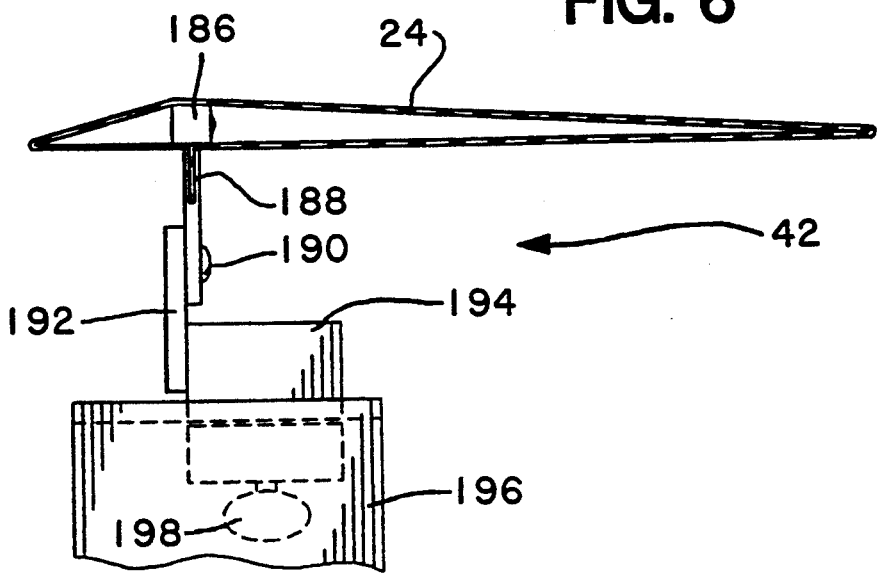
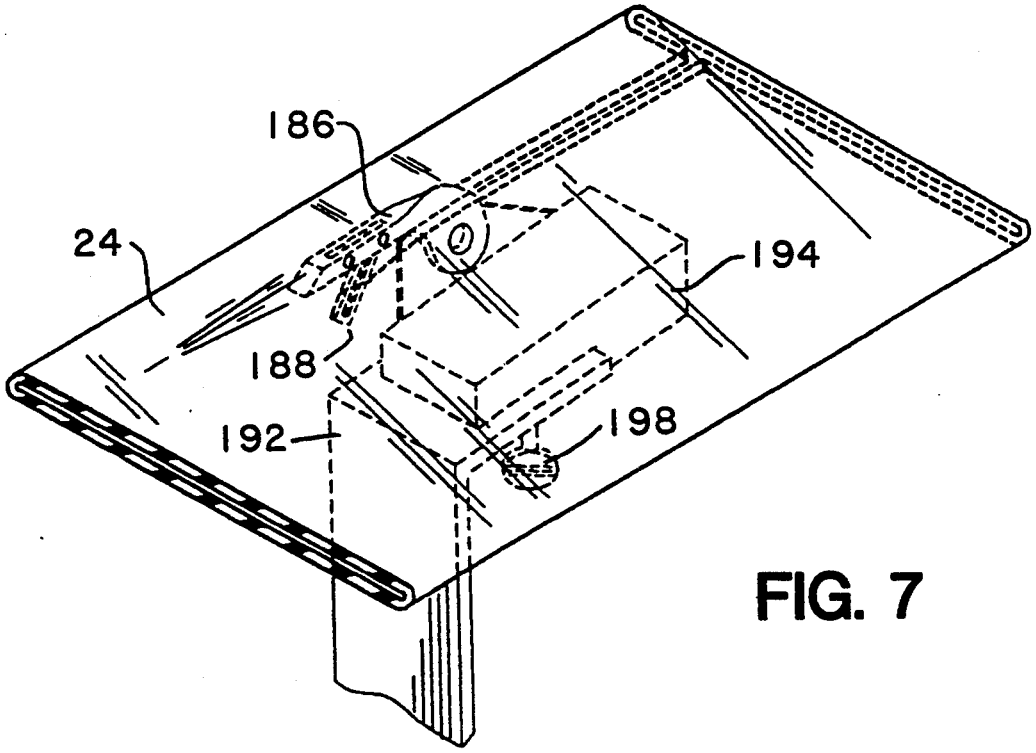
FIG. 7

MACHINE FOR REWINDING AND INTERMEDIATELY PROCESSING THIN FLEXIBLE MATERIAL USING A CONVEYOR

This application is a continuation-in-part of my copending application Ser. No. 07/779,105, entitled "Machine For Pre-Forming and Rewinding Film for Side Welded Bags," filed Oct. 18, 1991, now U.S. Pat. No. 5,194,062 which application is incorporated by reference herein as if fully set forth and which in turn is a continuation-in-part of application Ser. No. 07/539,129, entitled "Machine to Pre-form Film for Side Weld Bags," filed on Jun. 18, 1990, and now abandoned.

FIELD OF THE INVENTION

The present invention relates to an apparatus and method for the intermediate processing and rewinding of thin, flexible material. The invention particularly relates to a method and apparatus having simplified tension and torque control devices for preventing permanent elongated deformation of the material and accumulation of air in between successive layers of rewound material.

BACKGROUND OF THE INVENTION

The intermediate processing of stock is known as converting. The basic function of the converting industry is to intermediately process flexible materials, such as paper, plastic, cardboard, or light foil for subsequent use in, for example, the packaging industry. A large volume of the stock material to be converted in is roll form. The conversion of these materials includes, for example, printing, slitting, and trimming as the material is conveyed from a supply roll onto a rewind roll. For certain applications, the conversion process may simply comprise rewinding selected lengths of material from a supply roll onto a rewind roll in preparation for further processing. The stock material is often converted using rewinding machines equipped with devices to perform one or more of the selected intermediate processes.

There are two conventional types of rewinders in general use for converting thin, flexible materials such as plastic film. Both types of conventional rewinders have a set of positively driven primary draw rollers which initially draw the thin web of material from a supply roll. The web is then drawn by a rewinding spindle or core from the primary draw rollers over a series of idler rolls which smooth and guide the web onto the spindle or core. One or more converting processes may be performed on the material before it is rewound on the rewind spindle or core. The two conventional types of rewinders differ, however, in the manner by which the material is drawn from the primary draw rollers and transferred to the rewind roll.

The first type of conventional rewinders are known as surface driven rewinders which include one or more positively driven rollers whose surface contacts the outside layer of material being applied to a freely rotatable rewind core. The friction force created by the rotating surface drive rollers on the outer layer of material on the freely rotatable rewind core simultaneously creates a positive pull on the material and rotates the rewind core. The surface drive rollers are driven at a speed slightly greater than the speed of the moving web so as to create a positive pull on the material.

Some materials have a very smooth and slippable surface. To create a friction force of sufficient magnitude for the conventional surface rewind apparatus to draw this type of material from the supply roll and to turn the rewind core, the surface drive rollers must forcibly contact the outer layer of material on the core. Another reason the surface drive rollers must forcibly contact the rewind core is to prevent the accumulation of air in between successive layers of rewound film. The core is mounted in a "floating" axis of rotation above the surface driven rollers. A portion of the contact force results from the weight of the core and the weight of the accumulated material on the core. However, for successful surface-driven rewinding it is still often necessary to provide a mechanical, pneumatic or hydraulic device which sufficiently increases the contact force between the rewind core and the surface drive rollers beyond the force created by the combined weight of the core and rewound material, particularly at the beginning of the rewind process when the weight of the material on the rewind core is not significant.

Another problem with surface driven rewinders is that the aforementioned device for increasing the contact force between the drive rollers and the rewind core must be continuously adjusted during the converting process. As material is continuously applied to the rewind core, the diameter and weight of the roll steadily increases thereby steadily increasing the contact force on the surface drive rollers. Consequently much more air is squeezed out of the outer layers of material than out of the inner layers of material which results in a rewound roll having a soft interior. This phenomenon may cause further problems when the rewound roll is processed or rewound again. Additionally, the rewound roll may have a telescopic or other irregular shape. Thus, an additional mechanical, pneumatic or hydraulic adjustment mechanism must be provided to compensate for the steady increase in the contact force exerted on the surface drive rollers. This adjustment mechanism also adds to the complexity and cost of the surface driven rewinder.

The second type of conventional rewinders are center-driven rewinders which include a positively driven spindle on which the material is wound to produce the rewound roll. The shaft of the spindle is driven by a motor independent of any initial or intermediate draw rolls. The web is pulled by the rotating spindle which continuously winds successive layers of material onto the spindle.

One problem associated with center-driven rewinders is maintaining a constant tension on the web as the weight and diameter of the rewind roll steadily increase. As the diameter of the rewind roll increases, the tangential velocity of the roll also increases. Further, as the weight of the roll increases, an increase in motor torque is required to rotate the spindle. To compensate for these changing conditions, the angular velocity of the spindle must be reduced but the motor torque must be increased.

Few, if any, constant horsepower motors have heretofore been able to provide a constant horsepower output throughout the build-up range of the rewind roll. The motor will, at times, exert excessive tension on the web causing plastic deformation of the web. Conventional center-driven rewinders also exert excessive tension on the web by design to prevent the accumulation of air in between successive layers of material in the rewind roll. While some center-driven rewinders use a freely-rotatable doctor roll contacting the rewinding roll to prevent entrapment of air in between successive layers of material, excessive tension is still created on the web which causes stretching and plastic deformation. Thus, center-driven rewinders are often impractical for use with thin, plastic material.

SUMMARY OF THE INVENTION

The present invention provides an improved rewinding machine for intermediately processing thin, flexible material. In operation the present rewinding machine draws, intermediately processes, and transfers a web of thin flexible material from a supply roll to a rewind roll. Unlike conventional center-rewind or surface-rewind machines, the present invention converts the web without exerting excessive tension on the web which would plastically deform the material and without excessively compressing the outer layers of the rewound roll.

The rewinder of the present invention uses a set of positively driven primary draw rollers to initially draw the web at a constant speed from a supply roll over a series of idler rollers which smooth and guide the web. The web may pass through an initial converting process before it reaches the primary draw rollers. Unlike conventional center-driven rewinders or surface-driven rewinders, the present rewinder uses a driven conveyor to carry and deliver the web from the primary rollers and to transfer the web to a rewind spindle without plastically deforming the material or excessively compressing the rewound roll. For this reason the present invention cannot be characterized as either a center-driven rewinder or a surface-driven rewinder.

The conveyor delivers the web at the same constant speed as the primary draw rolls through one or more processing operations which may include, for example, slitting, perforating, trimming or folding the web. The conveyor includes at least one positively driven secondary draw roll and at least one transfer drum which is in peripheral contact with the rewind spindle. The intermediate delivery of the web by the conveyor eliminates the need to draw the web onto the rewind spindle directly from the primary draw rollers.

The rewind spindle is also positively driven slightly faster than the draw rolls and the transfer drum but does not itself act as a draw means. Since the conveyor conveys the web through the processing operations and directly transfers the web onto the rewind spindle, the spindle need only create a small degree of over-pull in the web to tightly rewind the web and to prevent the accumulation of air in between successive layers of material. Since the transfer drum exerts a resistive drag on the spindle at the peripheral contact or transfer point, the transfer drum acts a regulator to control the speed of the spindle as the diameter of the material wound on the spindle increases.

The conveyor does not pull or exert any significant tension on the web but merely carries the web through an additional converting process before transferring the web to the rewind spindle. The only tension created on the web is created by the primary draw rolls and the over-pull of the rewind spindle. In each of these instances, the tension is constantly regulated by a slippable clutch.

Each of the driven rolls and the rewind spindle are integrally linked by a transmission which synchronizes the relative movement of each moving element relative to the transfer drum to prevent any tension on the web which would plastically deform the material. Most importantly the transmission adjusts the angular velocity of the spindle to compensate for the increased tangential velocity as the diameter of the rewound material on the spindle increases. The relative speeds of the draw rolls and rewinding spindle are controlled by gear linkage, a clutch, and the resistive peripheral contact force exerted by the transfer drum on the spindle so that the tension on the web never exceeds the web's yield strength.

The invention further includes a slitting means which is positioned proximate to the peripheral contact point or transfer point on the transfer drum. The slitting process may occur while the web is still contacting the transfer drum to prevent the edges of the adjacent strips of web from overlapping.

BRIEF DESCRIPTION OF THE DRAWINGS

FIG. 6 is an enlarged sectional view taken on line 6—6 of FIG. 2 showing the cutout slitters and lip maker;

FIG. 7 is a perspective view of the mechanism of FIG. 6;

DETAILED DESCRIPTION OF THE PREFERRED EMBODIMENTS

Figure 2:
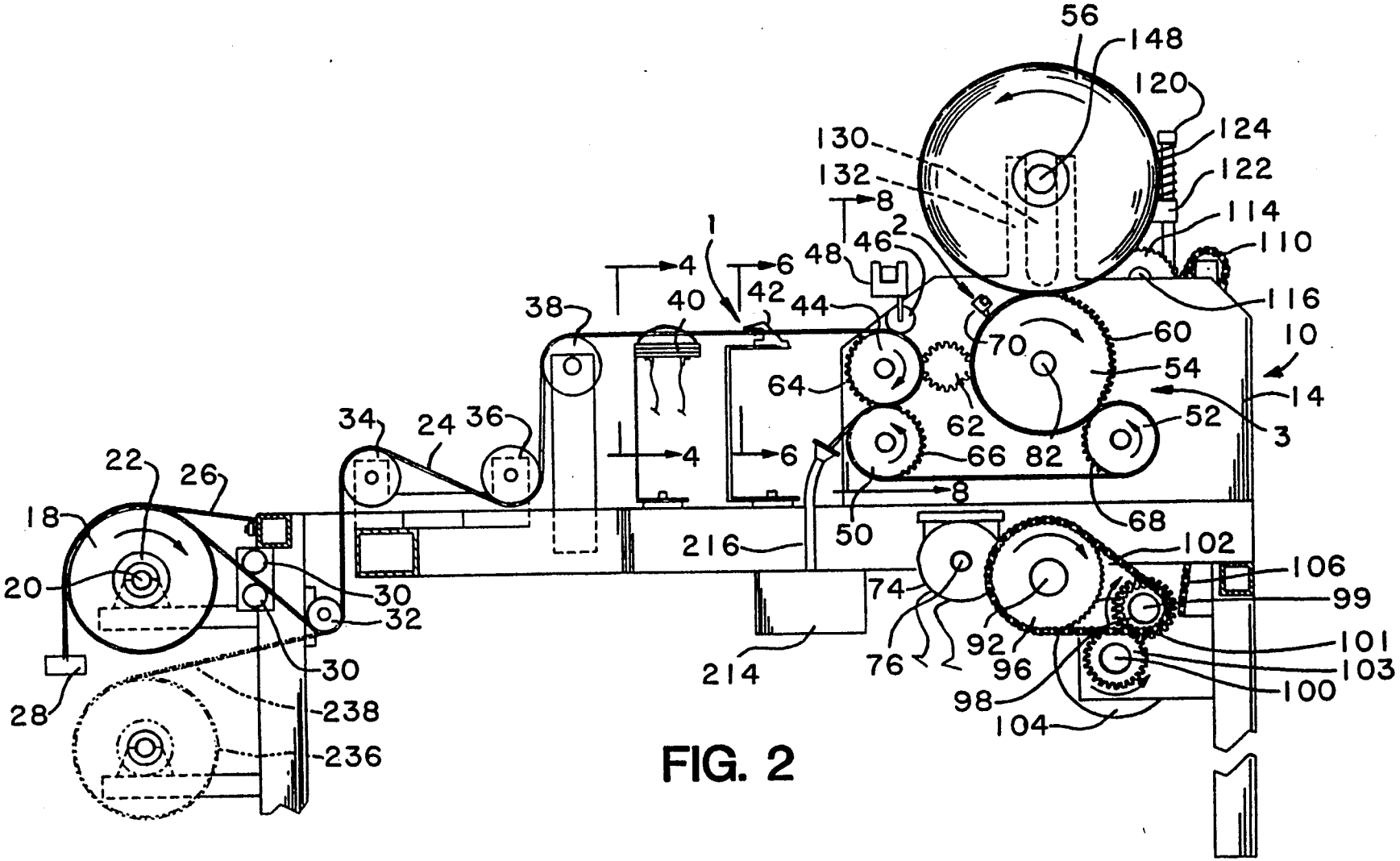
FIG. 2 is a sectional view taken on line 2—2 of FIG. 1.

Referring more specifically to the drawings, FIG. 2 shows a machine, generally designated 10, for rewinding and intermediately processing a web of material in accordance with one embodiment of the present invention. A web 24 is drawn from a supply roll 18, described in more detail below, by a pair of driven primary draw rolls 44, 50, through a pair of guide rolls 30, over a series of idler rolls, 32, 34, 36, 38 and through a first processing area, generally designated 1. The material may undergo a variety of converting processes in this first processing area 1 including printing, perforating, slitting or trimming, several of which will be more fully described below. If it is desired to simply rewind a roll of material without intermediately processing it, any processing equipment in the first processing area 1 is either withdrawn or removed.

After the web passes through the primary draw rolls, the web is conveyed by a conveyor, generally designated 3, through a second processing area, generally designated 2, and is then transferred directly onto the rewind spindle assembly 58. The conveyor distinguishes the present invention from conventional surface-driven or center-driven rewinders in which the web is wound onto the spindle directly from the draw rolls.

Figure 11:
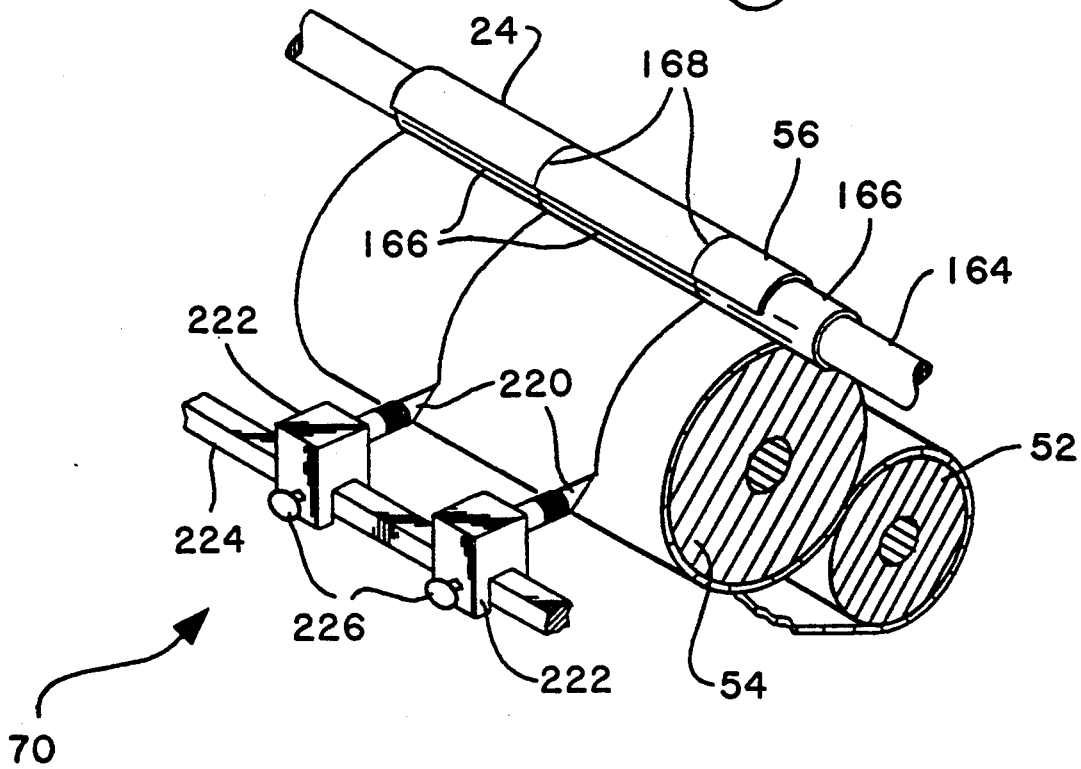
FIG. 11 is a perspective view of the web moving drum and rewind roll showing multiple slitters used in conjunction with the drum.

In one embodiment of the present invention, the conveyor comprises a positively driven secondary draw roll 52 and a transfer drum 54, as seen in FIGS. 2 and 11. The secondary draw roll 52 is used to maintain the speed and tension of the web as it passes 25 from the primary draw rolls to the transfer drum 54. The positively-driven secondary draw roll 52 is supported relative to the frame intermediate the primary draw rolls 44 and 50 and the transfer drum 54 for delivering the web of material from the primary draw rolls to the transfer drum. The secondary draw roll is in peripheral contact with the transfer drum to transfer the web from the secondary draw roll directly onto the transfer drum at the peripheral contact between the secondary draw roll and the transfer drum. The secondary draw roll exerts just enough tension on the web to keep the web taut without stretching it. As seen in FIG. 2, the material then travels over the secondary draw roll onto the transfer drum.

A significant aspect of the present invention is the intimate relationship of the conveyor and spindle whereby the transfer drum of the conveyor is in peripheral contact at a contact point with the material rewound on the spindle. The transfer drum is designed to perform several important functions in the intermediate processing and rewinding of the web. The drum conveys or carries the web through the second processing area 2. Since the web stays in contact with the transfer drum as it travels through the secondary processing area 2, slitting can be performed more efficiently on the web. The surface contact between the web and the transfer drum 54 prevents separation or distortion of the longitudinal slitted portions of the web due to axial movement away from each other. In this way the edges of the slitted portions of web will not overlap as they are placed on the rewind spindle.

The transfer drum provides for immediate take-up of the web onto the roll 56 thereby preventing any web sag which could cause wrinkling. The transfer drum also uniformly compresses the rewound material to prevent the accumulation of air in between the successive layers of material.

The transfer drum also maintains the peripheral speed of the rewind spindle by exerting a resistive drag on the spindle. As the diameter of the material rewound on the spindle increases, the tangential velocity of the rewound roll increases. To maintain the tangential velocity of the rewound roll on the spindle consistent with the transfer drum, the drum provides a resistive drag on the outer layer of the rewound roll and reduces the speed of the spindle. The spindle assembly is provided with a clutch, described in greater detail below, which permits the transfer drum to vary the speed imparted on the spindle by the spindle drive mechanism or transmission. The resistive drag force is essentially orthogonal to the web, and does not impart a longitudinal stretching force on the web.

Since the rewind spindle does not act as a draw means, the spindle need only be driven slightly faster than the transfer drum to keep the web taut and prevent air from accumulating in between successive layers of material. The intimate association of the rewind assembly and transfer drum retains all the advantages of a conventional-type center driven rewinder, but a constant horsepower, variable torque motor is not needed to maintain a constant tension of the web during roll build-up. The tension of the web is maintained by the over-pull of the rewind spindle which is controlled by the resistive drag of the transfer drum and the slippable clutch.

The diameter of the transfer drum is determined by the gauge of the web and the desired number of slits in the web. The relatively large circumference on the transfer drum allows a more even pull on the web, thereby reducing the tendency of the web to wrinkle. Further, a large diameter transfer drum is needed for proper razor slitting. If the radius of curvature at the cutting location is too small, razor slitting can be problematic due to the attack angle of the razor.

Preferably, the rewind spindle is mechanically linked to the transmission but may be driven by a separate motor other than the one that drives the transmission so long as means are provided for permitting the drag of the transfer drum to slow the rewind roll. A slippable clutch is provided to permit the speed of the rewind spindle to be varied from the speed imparted by the transmission due to the drag of the transfer drum.

The rewind spindle "floats" to accommodate the increasing diameter of the rewind roll. The shaft 148 is mounted between blocks 128 which move vertically in slots 130 of standards 132 on the frame. This permits the spindle 164 and the rewind roll thereon to automatically "float" or move upwardly transverse to the spindle axis of rotation as the diameter of the roll 56 increases. When the spindle reaches its top most position, it is temporarily locked in place by the set screws 134. This permits removal of the spindle core and its rewound roll from the machine and replacement with an empty core. The set screws 134 are then released to permit the spindle to move downwardly.

The floating spindle also permits relatively uniform pressure between the transfer drum and the rewind roll to be maintained. The amount of pressure is determined by selectively weighting the spindle assembly. The weight of the roll tends to increase the pressure between the transfer drum and the rewind roll.

The supply roll 18 comprises a freely rotatable spindle 20 and a core 22 on which a web 24 of thin, plastic film is wound. The web may be formed as single-ply or multi-ply sheet, or as flat, tubular sheet. A weighted hold-down strip 26 extends from the frame of the machine over the outer layer of the supply roll 18 to keep the web taut.

The transmission comprises geared linkage which integrally links and drives each of the draw rolls, the transfer drum, and the rewind spindle. The shaft 82 of the transfer drum 54 is provided with a gear 60 that drives a gear 62 which, in turn, drives a gear 64 of the anvil roller 44. The gear 64 drives the gear 66 of the roller 50. The gear 60 on the shaft of drum 54 also drives a gear 68 of the pinch roller 52. This gear arrangement, along with the clutch and drag of the transfer drum, act as a control means to provide synchronous rotation of the transfer drum 54 and the associated rollers 44, 50 and 52, and the rewind spindle assembly 58 to uniformly draw and maintain the tension and movement of the web.

Figure 3:
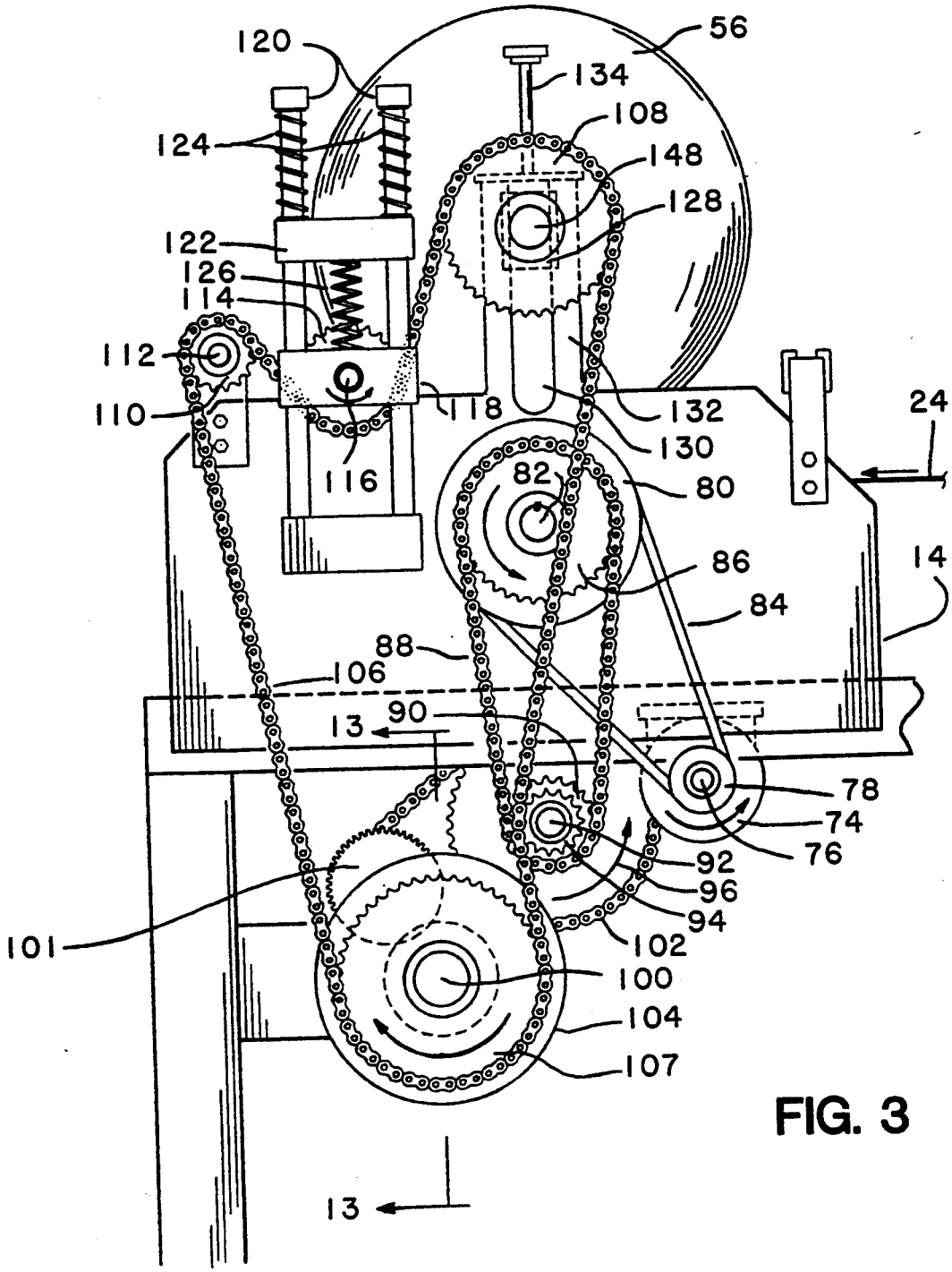
FIG. 3 is an enlarged detailed side elevational view of the drive assembly taken on line 3—3 of FIG. 1.

As best seen in FIG. 3, the web transfer drum 54 is driven by a drive means comprising a motor 74 having a drive shaft 76 on which is mounted a pulley 78. Pulley 80 is mounted on a shaft 82. The pulley 78 is operatively connected to pulley 80 by a drive belt 84. Coaxial with the pulley 80, is a sprocket 86 that is mounted on the shaft 82. This sprocket 86 is operatively connected by a chain 88 to a driven sprocket 90 mounted on a driven shaft 92. An idler sprocket 94 is mounted coaxially with sprocket 90 on shaft 92. The shaft 92 supports a driven sprocket 96 which is connected to a driven sprocket 98 on a shaft 99 by a chain 102.

The sprocket 96 has a larger diameter than the sprocket 98 so that there is an increase of speed of the sprocket 98 relative to the sprocket 96. Shaft 99 is associated with shaft 100 by gears 101 and 103. This changes the direction of rotation of the drive force from that of shaft 99. The shaft 100 supports a slip clutch 104, hereinafter more fully described.

The slip clutch 104 is provided with a drag that is transferred from the slip clutch sprocket 107 through a chain 106 to a "floating" sprocket 108 via an idler sprocket 110 mounted on a shaft 112, and to a "floating" idler sprocket 114 mounted on a spring-pressed shaft 116. The shaft 116 is mounted on a block 118 movable on rods 120. A block 122 is spring-pressed downwardly by springs 124 mounted on the rods 120 and is spring-pressed upwardly by a spring 126 positioned between the block 118 and the block 122. The sprocket 94 acts to tension the chain 106 prior to its movement onto sprocket 107. This spring-pressed construction provides compensation for any slack in the chain 106 due to variation in the diameter of the rewind roll 56 as the amount of rewound material on the roll varies. As noted above with reference to FIG. 1, counterweight 59 balances the pressure exerted on the spindle by drive chain 106.

Figure 13:
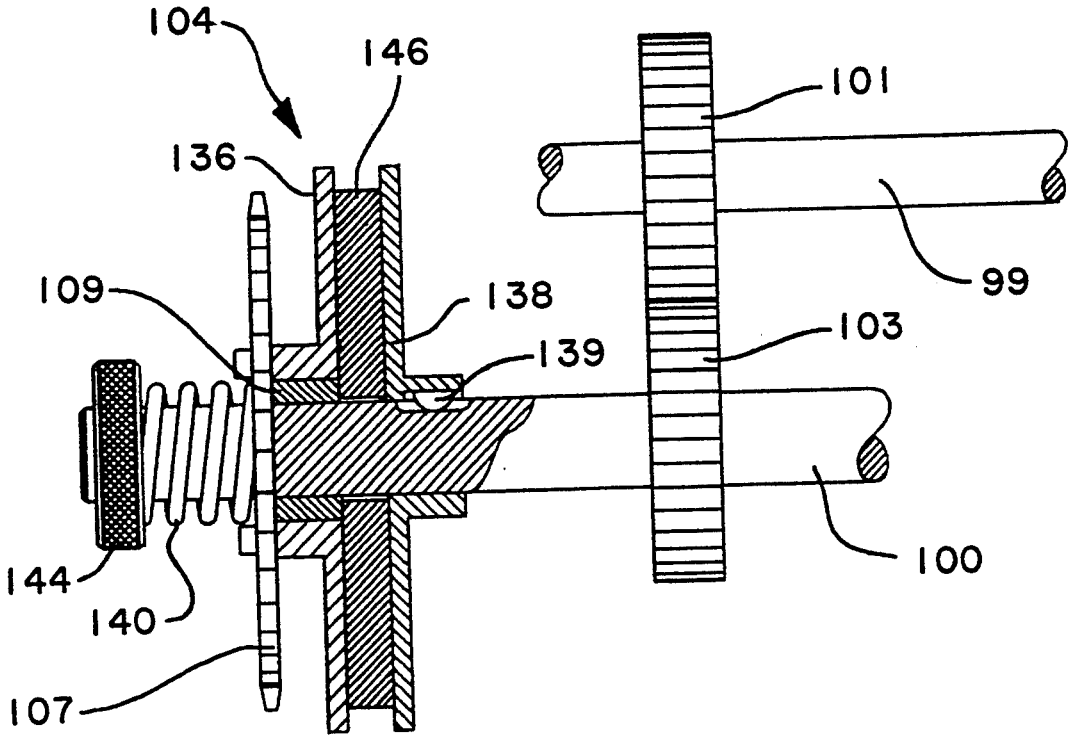
FIG. 13 is a sectional view taken on line 13—13 of FIG. 3 of the slippable clutch mechanism.

The slip clutch 104 is shown in detail in FIG. 13 and comprises two face plates 136 and 138. Face plate 138 is connected to drive shaft 100 via key 139. Face plate 136 is rotatably mounted on shaft 100 via a bearing 109. Between the two places 136 and 138 is a friction disc 146 which exerts a drag between the two face plates. A sprocket 107 is rigidly affixed to plate 136. A spring 140 extending around the shaft 100 and bearing against the sprocket 107, biases one face plate 136 toward the other face plate 138. A nut 144 engaged with the threaded end of the shaft 100 is provided to adjust the bias exerted by the spring on the face plates 136 and 138.

Figure 14:
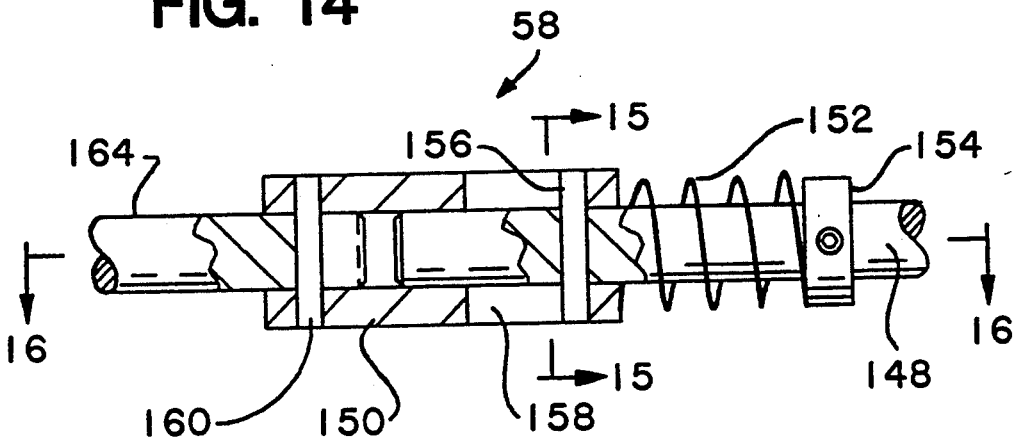
FIG. 14 is an enlarged sectional view taken on line 14—14 of FIG. 1 of the removable spindle assembly.
Figure 15:
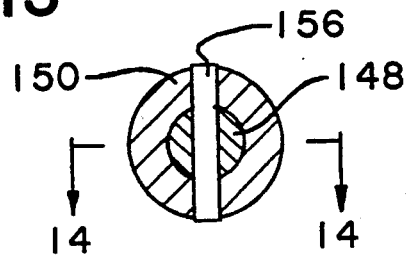
FIG. 15 is a sectional view taken on line 15—15 of FIG. 14 of the drive axis and associated pin.
Figure 16:
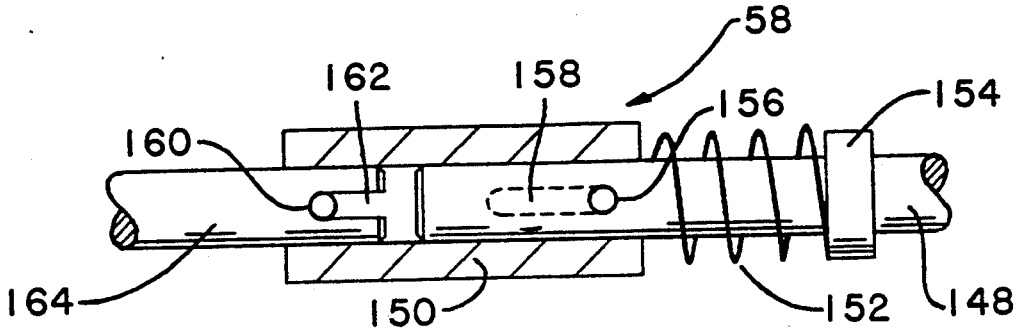
FIG. 16 is a sectional view taken on line 16—16 of FIG. 14 of the removable spindle assembly.

The rewind spindle assembly 58 is shown in more detail in FIGS. 14, 15 and 16 and comprises a drive shaft 148 upon which a sleeve 150 is slidably mounted. A counterweight 59 is attached to one end of the rewind spindle 164 to balance the pull of the chain drive so that the spindle exerts evenly distributed pressure on web transfer drum 54. A spring 152 is disposed on the shaft 148 between the sleeve 150 and an adjustable collar 154. The spring 152 is compressed between the sleeve 150 and the adjustable collar 154 and the spring 152 biases the sleeve 150 into engagement with spindle portion 164.

Figure 1:
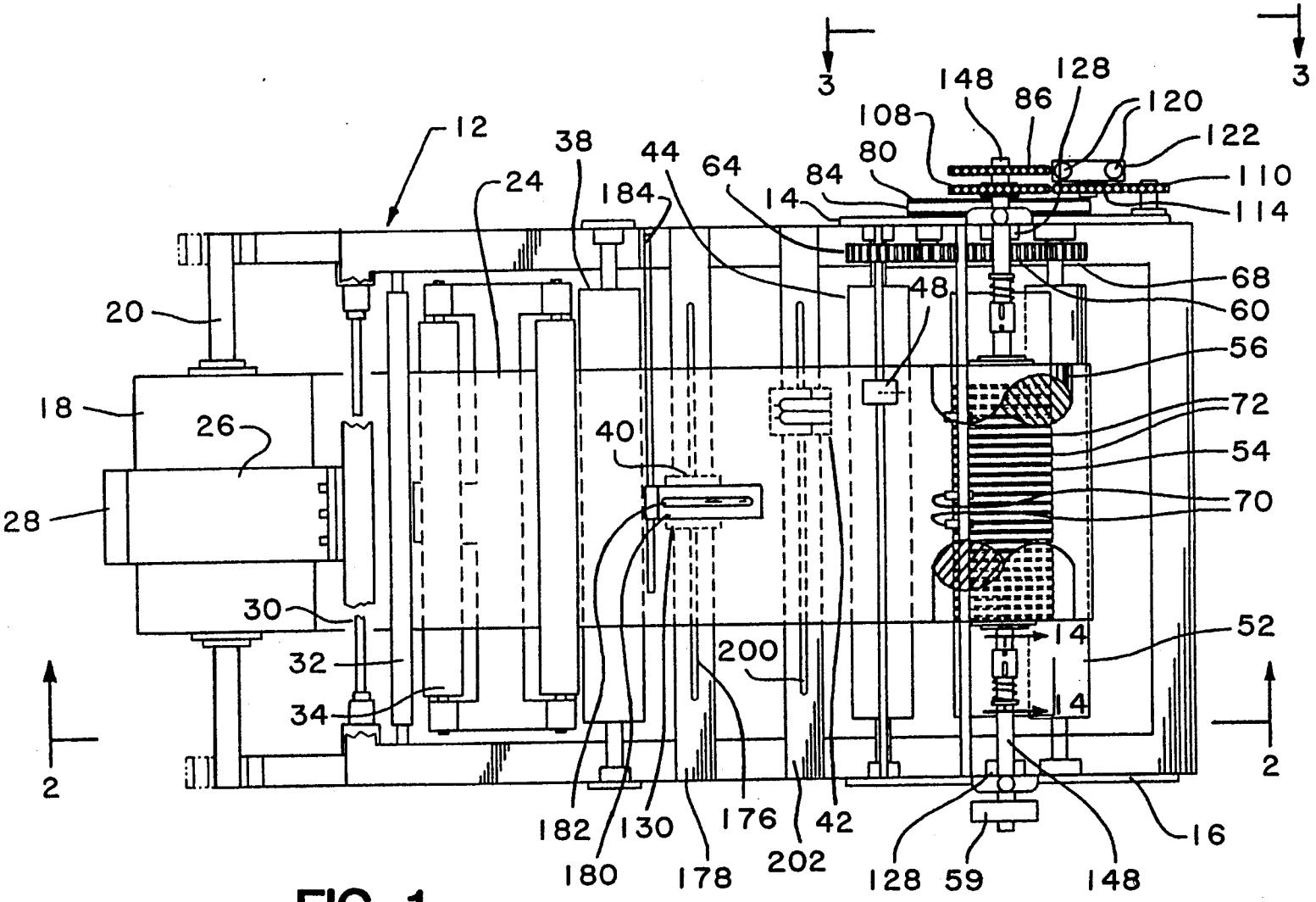
FIG. 1 is a top plan view, partially broken away, of a machine embodying the present invention.

The shaft 148 is driven by the sprocket 108 and is connected to the sleeve 150 by a pin 156 disposed in opposing slots 158 in the sleeve. The sleeve is provided with a pin 160 which engages spindle portion 164. The spindle portion 164 is removable from the sleeve 150 by sliding the sleeve to the right to release the pin 160 from the slot 162. The connection between the spindle portion 164 and the sleeve 150 is releasably maintained by the spring 152 until the spindle portion 164 is positively removed. A similar slide sleeve mechanism is used to lock and release the opposing end of spindle portion 164 as shown in FIG. 1.

The spindle portion 164 is adapted to hold either one or a plurality of cores 166. Three axially arranged cores 166 are shown in FIG. 11. These cores receive the rewound web 24 which, as shown in FIG. 11, has been slit, as at 168, to form three separate rolls. These rolls are removable from the spindle by removing the spindle portion 164 in the manner described above. Empty cores are then installed on spindle portion 164 which is then reinstalled on the machine.

FIGS. 4 through 11 illustrate a variety of different ways of processing the web. The types of processing in a particular instance is determined by need and may include one or more processing operations.

Figure 4:
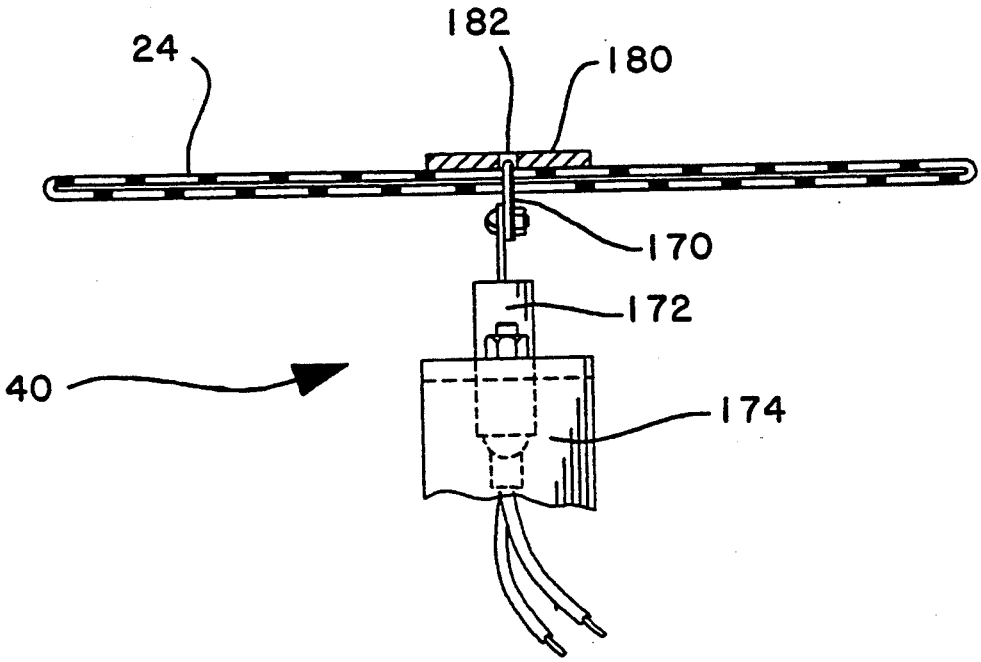
FIG. 4 is a sectional view taken on line 4—4 of FIG. 2 showing the slit and seal knife.
Figure 5:
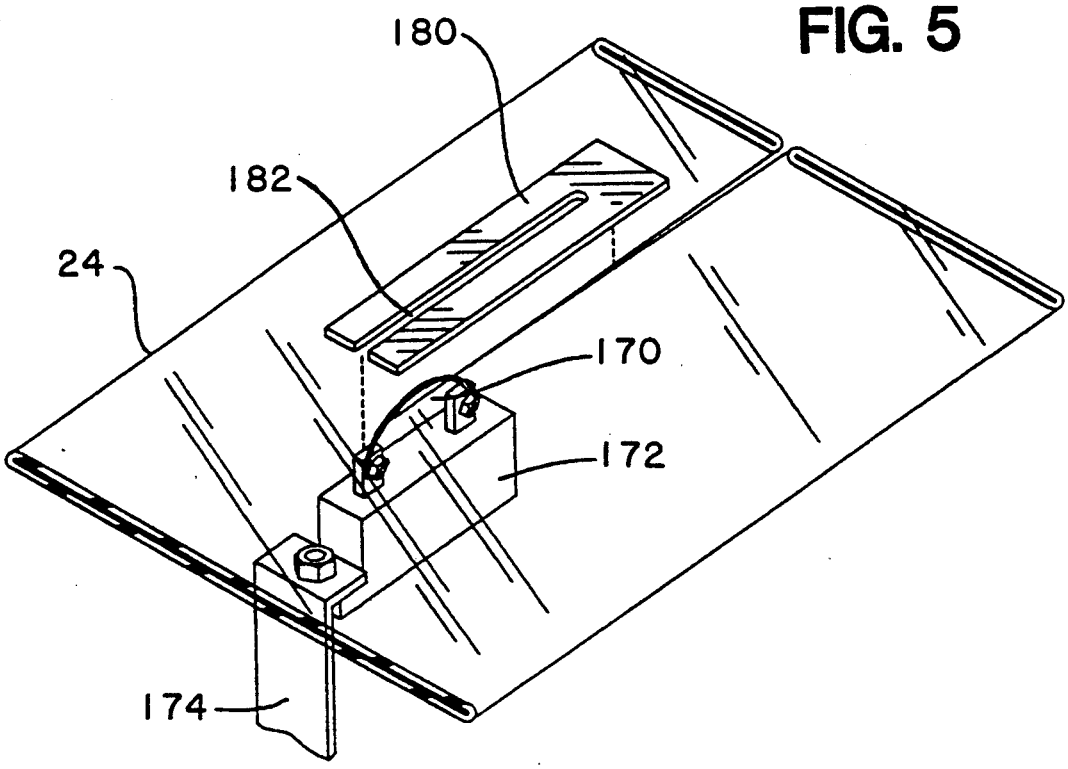
FIG. 5 is a perspective view of the slit and seal knife of FIG. 4.

The web, for example, may be tubing or overlapped plies of sheet or film. FIGS. 4 and 5 illustrate the processing of a web 24 having a tubular configuration for making plastic bags. First the web 24 passes over the slit and seal assembly 40 where the web is longitudinally slit and is heat sealed by a heated blade or knife 170. The knife 170 is mounted on an electrical heating element 172 which is mounted on a transversely adjustable bar 174. The heated blade 170 co-acts with a clamping plate 180 which has a slot 182 and which overlies the web 24. The heated blade is received in the slot 182 during the slitting process. The clamping plate 180 is also transversely adjustable which allows the web to be slit at any lateral position. If desired, a plurality of such heated slitting means may be provided.

While making the bags, it is often desirable to form a lip at the mouth of the bag. The lip is formed by cutting or slitting only one wall of the bag to form an open mouth while leaving the other edge portion intact. The assembly 42 which accomplishes this is more specifically shown in FIGS. 6 and 7. The assembly comprises a plough 186 and a slitter 188 pivotally mounted at 190 on a bracket 192 extending from a block 194 connected to a bar 196 by a set screw 198. The assembly 42 is transversely adjustable along a slot 200, shown in FIG. 1, which allows the device to be used at any desirable lateral position on the web. If desired, a plurality of such slitter assemblies may be provided.

In operation, the plough 186 is initially set between the upper and lower plies of the tubular web 24 with the slitter 188 under t he lower ply. As the web 24 moves through the machine the plough 186 spaces the upper ply from the lower ply so that the slitter 188 slits only the lower ply.

Figure 8:
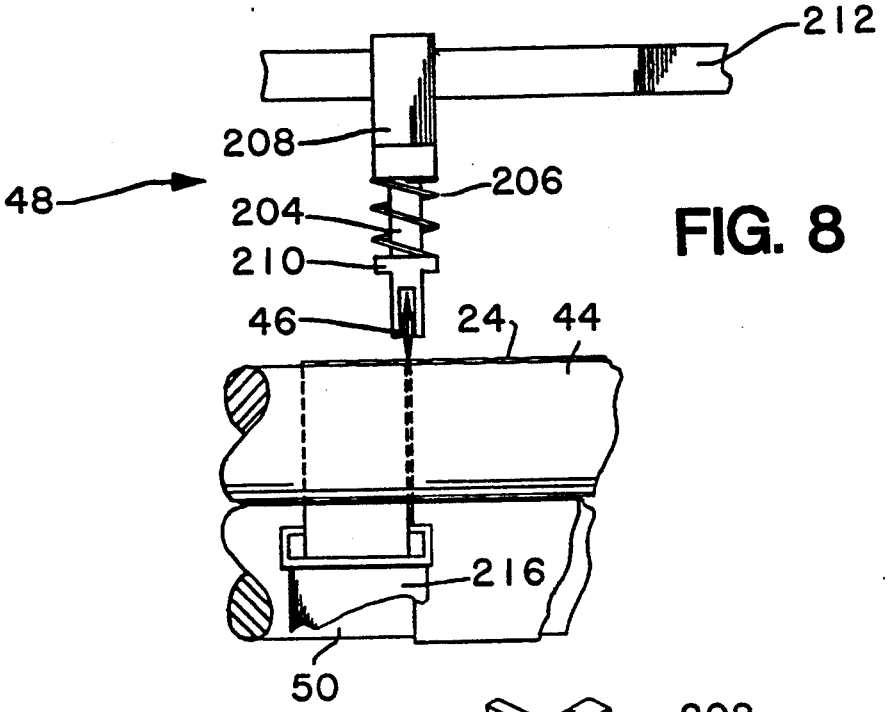
FIG. 8 is a sectional view taken on line 8—8 of FIG. 2, showing the perforating wheel and associated elements.
Figure 9:
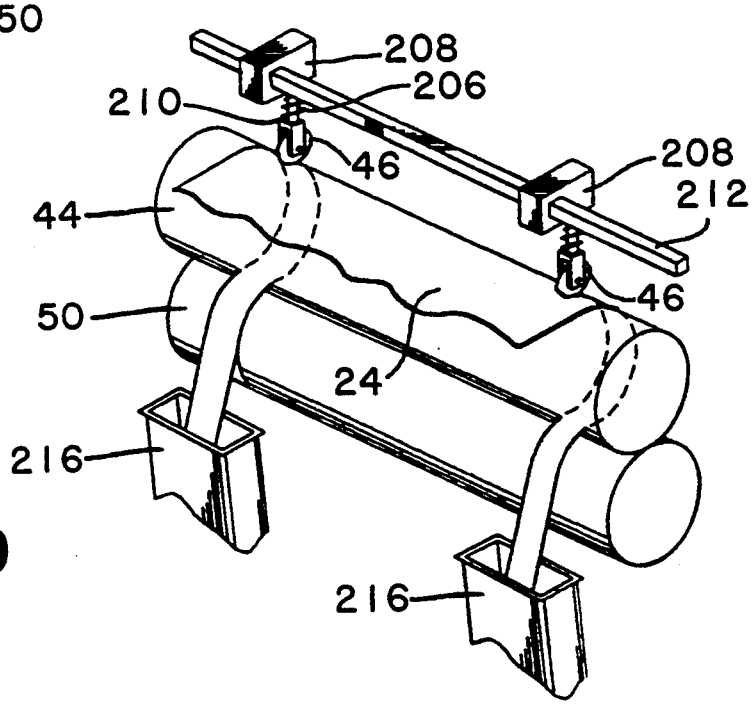
FIG. 9 is a perspective view of the mechanism of FIG. 8.

In a trimming process, excess material may be severed and disposed of by the mechanism 48 shown in FIGS. 8 and 9. The mechanism comprises a rotary cutter 46 supported by a rod 204 which is spring-pressed by a spring 206, positioned between a bearing portion of a block 208 and a collar 210. The cutter 46 makes peripheral contact with an anvil roller 44 to trim the web. The block 208 is laterally adjustable along a rod 212 extending across the frame 12. The excess or waste material is discarded through a receptacle 214 by vacuum means 214 shown in FIG. 2.

Figure 10:
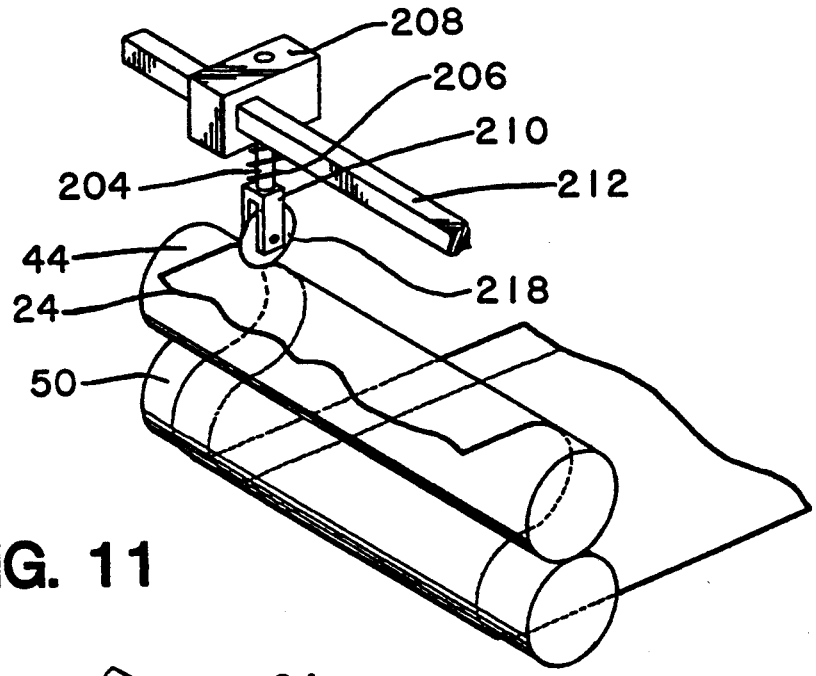
FIG. 10 is a perspective view of an alternative perforating wheel in the form of a perforator.

If it is desired to provide a line of perforations rather than a total slitting, the cutter 46 may be replaced by a serrated disc 218 as seen in FIG. 10. Otherwise, the mechanism is the same as in FIG. 9; however, since there is no complete severance of any material, the vacuum means are not needed.

Figure 12:
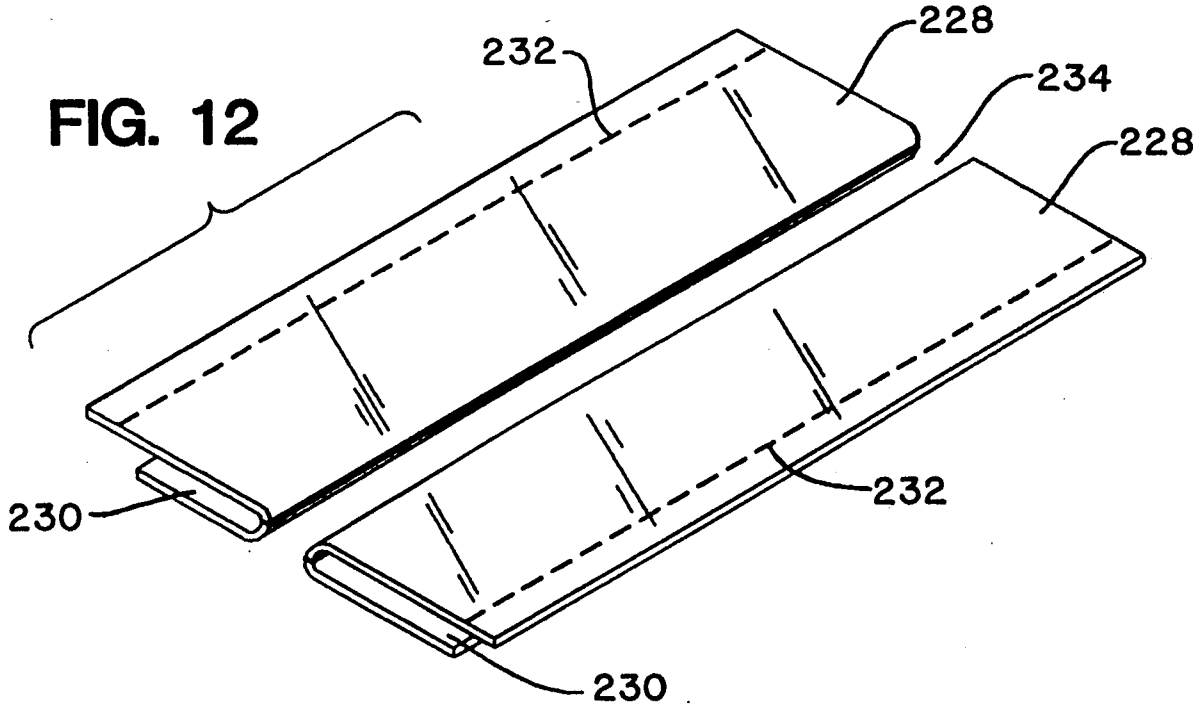
FIG. 12 is a perspective view of a processed material after having been cut and perforated.

FIG. 12 is illustrative of a pair of bag forms, designated 228, after they have been processed by the above-described machine but before they have been finally cut and sealed to form the actual bags. The lips 230 have been formed by the mechanism 42 shown in FIG. 6 and the severance between the two units, shown at 234, was provided by the hot blade mechanism 40 shown in FIGS. 4 and 5.

FIG. 11 is a detailed illustration of the slitter assembly 70 showing two slitter blades 220, each extending from a block 222 slidably mounted on a rod 224 for lateral adjustment. The slitters 70 make contact with the periphery of the web transfer drum 54 to longitudinally slit the web. Optionally, peripheral grooves 72 may be provided on the drum 54 and are used in conjunction with the slitters 70. A set screw 226 holds each slitter block 222 in position. The slitters 220 may be omitted if only one core is used. The number of slitters 220 depends on the number of cores 166 on the spindle 164. Three cores 166 and two slitters 220 are, however, usually preferred.

The invention has been described above in conjunction with the use of a tubular web. However, sheet material may also be used to form a double ply material. For this purpose, an optional second supply drum or roll 236, shown in FIG. 2, may be used. This roll 236 is mounted on the frame in a similar manner to the roll 18 but below it as shown in FIG. 2. The material 24 from the upper roll 18 would then be sheet-like rather than tubular and a similar sheet-like material, designated 238, would be applied from the roll 236 around the roller 32, where it would mate, face-to-face, with the sheet material from the roll 18 and form a double ply web. From that point on the process would be the same as described above.

Although the invention has been described with particular regard to bag making, it is not limited thereto; it may be used with the processing of plastic webs in general. In this respect, if the various cutting, perforating and sealing devices described above are not utilizable in the particular process being employed, they may be made inoperative or even removed as desired.

What is claimed is:

1. A machine for rewinding a web of thin flexible material comprising:

(a) a frame;

(b) a pair of positively-driven primary draw rolls supported relative to the frame for removing the web from a supply roll;

(c) a positively-driven center-rewind spindle onto which the web of material is rewound as a roll supported relative to the frame;

(d) a positively-driven conveyor supported relative to the frame for carrying said web from said primary draw rolls and transferring said web onto said rewind spindle, said conveyor including (1) a transfer drum supported relative to the frame in peripheral contact at a contact point with the roll of material wound onto said spindle so that the web of material is transferred directly at the contact point from the transfer drum onto the roll of material wound on the spindle and (2) a positively-driven, secondary draw roll supported relative to the frame intermediate the primary draw rolls and the transfer drum for delivering the web of material from the primary draw rolls to the transfer drum, said secondary draw roll in peripheral contact at a contact point with said transfer drum to transfer the web from the secondary draw roll directly onto the transfer drum at the contact point between the secondary draw roll and the transfer drum; and, (e) a control mechanism for controlling synchronous movement of said primary draw rolls and said spindle relative to said conveyor so that the web is carried by the conveyor from the primary draw rolls to the center-rewind spindle with the center-rewind spindle applying only sufficient tension to maintain the web in flat surface contact with the transfer drum as the web is rewound onto the spindle.

2. The machine as recited in claim 1 wherein said transfer drum exerts a resistive drag on the roll of material wound onto said spindle to limit the velocity of said spindle relative to said transfer drum.

3. The machine as recited in claim 1 wherein said control mechanism comprises a transmission which links and drives said primary draw rolls, said secondary draw roll, said spindle, and said transfer drum in synchronism.

4. The machine as recited in claim 3 wherein said control mechanism comprises a clutch which permits the speed of said rewind spindle to be varied from the speed imparted by said transmission.

5. The machine as recited in claim 1 wherein slitting means are supported relative to the frame proximate to said contact point between said transfer drum and the roll of material wound onto said spindle to slit said web.

6. The machine as recited in claim 5 wherein said transfer drum is provided with circumferential grooves which align and coact with said slitting means to facilitate the slitting of the web on the transfer drum.

7. The machine as recited in claim 6 wherein said rewind spindle comprises a plurality of axially adjacent cores positioned on said spindle, each core receiving and rewinding a separate portion of the web slit by said slitting means.

8. The machine as recited in claim 1 wherein said rewind spindle has an axis of rotation which is movable in a direction transverse to said axis of rotation as the diameter of the roll of material on said spindle increases.

9. A machine for rewinding a web of thin flexible material comprising:

(a) a frame;

(b) a positively-driven center-rewind spindle on which the web is rewound as a roll supported relative to the frame;

(c) a series of positively driven rolls supported relative to the frame for removing the web from a supply roll and transferring the web to said spindle, including i) a set of primary draw rolls for removing the web from the supply roll;

ii) a positively driven transfer drum for carrying the web removed from the supply roll by said primary rolls to the roll of material on said spindle, said transfer drum in peripheral contact at a contact point with the roll of material on said rewind spindle to directly transfer the web from the conveyor onto the roll on said spindle at the contact point;

iii) a positively-driven secondary draw roll for delivering the web of material from the primary draw rolls onto the transfer drum, said secondary draw roll in peripheral contact with the transfer drum to transfer the web from the secondary draw roll directly onto the transfer drum at the peripheral contact between the secondary draw roll and the transfer drum; and (d) a transmission positively driving said series of rolls and said rewind spindle in synchronous movement, said transmission controlling the relative speeds of said rolls and said spindle so that the web is transmitted by the series of positively driven rolls from the supply roll to the center-rewind spindle with the center-rewind spindle applying only sufficient tension to maintain the web in flat surface contact with the series of positively-driven rolls.

10. The machine as recited in claim 9 wherein said transfer drum exerts a resistive drag on the roll of material on said rewind spindle to control the velocity of said rewind spindle.

11. The machine as recited in claim 9 wherein slitting means are provided proximate to said contact point between said transfer drum and the roll of material wound onto said spindle to slit said web.

12. The machine as recited in claim 11 wherein said transfer drum is provided with circumferential grooves which align and coact with said slitting means to facilitate the slitting of the web on the transfer drum.

13. The machine as recited in claim 11 wherein said rewind spindle comprises a plurality of axially adjacent cores positioned on said spindle, each core receiving and rewinding a separate portion of the web slit by said slitting means.

14. The machine as recited in claim 9 wherein said rewind spindle has an axis of rotation which is movable in a direction transverse to said axis of rotation as the diameter of the roll of material wound onto said spindle increases.

15. The machine as recited in claim 9 wherein said transmission comprises gear linkage linking each of said rolls in said series and said spindle.

16. The machine as recited in claim 9 wherein said transmission comprises a clutch which permits the speed of said rewind spindle to be varied from the speed imparted by said transmission.

17. A machine for rewinding a web of thin flexible material comprising:

(a) a frame;

(b) positively-driven draw means supported relative to the frame for removing the web from a supply roll;

(c) a positively-driven center-rewind spindle onto which the web of material is rewound as a roll supported relative to the frame;

(d) a positively-driven conveyor supported relative to the frame for carrying said web from said draw means and transferring said web onto said rewind spindle, including:

i) a positively-driven transfer drum supported relative to the frame in peripheral contact at a contact point with the roll of material wound onto said spindle so that said web is directly transferred at the contact point from the transfer drum onto said roll of material wound onto the spindle;

ii) a positively-driven, web-carrying roll supported relative to the frame intermediate the draw means and the transfer drum for delivering the web of material from the draw means to the transfer drum, said web-carrying roll in peripheral contact with the transfer drum to transfer the web from the web-carrying roll directly onto the transfer drum at the peripheral contact between the web-carrying roll and the transfer drum; and (e) a control mechanism for controlling synchronous movement of said draw means and said spindle relative to said conveyor so that the web is carried by the conveyer from the draw means to the center-rewind spindle with the center-rewind spindle applying only sufficient tension to maintain the web in flat surface contact with the transfer drum and the web-carrying roll as the web is rewound onto the spindle.

18. The machine as recited in claim 17 wherein said transfer drum exerts a resistive drag on the roll of material wound onto said spindle to limit the velocity of said spindle relative to said transfer drum.

19. The machine as recited in claim 18 wherein said control mechanism comprises a transmission which links and drives said draw means, said spindle, and said transfer drum in synchronism.

20. The machine as recited in claim 19 wherein said control mechanism comprises a clutch which permits the speed of said rewind spindle to be varied from the speed imparted by said transmission.

21. The machine as recited in claim 20 wherein slitting means are supported relative to the frame proximate to said contact point to slit said web.

22. The machine as recited in claim 21 wherein said transfer drum is provided with circumferential grooves which align and coact with said slitting means to facilitate the slitting of the web on the transfer drum.

23. The machine as recited in claim 22 wherein said rewind spindle comprises a plurality of axially adjacent cores positioned on said spindle, each core receiving and rewinding a separate portion of the web slit by said slitting means.

24. The machine as recited in claim 17 wherein said rewind spindle has an axis of rotation which is movable in a direction transverse to said axis of rotation as the diameter of the roll of material on said spindle increases.

25. A machine for rewinding a web of thin flexible material comprising:

(a) a frame;

(b) primary draw means supported relative to the frame for removing the web from a supply roll;

(c) a positively-driven center-rewind spindle onto which the web of material is rewound as a roll supported relative to the frame;

(d) a positively-driven transfer drum supported relative to the frame for transferring said web onto said rewind spindle;

(e) a positively-driven, secondary draw roll supported relative to the frame intermediate the primary draw means and the transfer drum for delivering the web of material from the primary draw means to the transfer drum, said secondary draw roll in peripheral contact with the transfer drum to transfer the web from the secondary draw roll directly onto the transfer drum at the peripheral contact between the secondary draw roll and the transfer drum; and (f) a control mechanism for controlling synchronous movement of said primary draw means, said secondary draw roll, said transfer drum, and said spindle so that the web is carried from the primary draw means to the center-rewind spindle with the web in flat surface contact with the transfer drum as the web is rewound onto the spindle.

26. The machine as recited in claim 25 wherein said control mechanism comprises a transmission which links and drives said primary draw means, said secondary draw roll, said spindle, and said transfer drum in synchronism.

27. The machine as recited in claim 25 wherein slitting means are supported relative to the frame to slit the web.

28. The machine as recited in claim 27 wherein said transfer drum is provided with circumferential grooves which align and coact with said slitting means to facilitate slitting of the web on the transfer drum.

29. A machine for rewinding a web of thin flexible material comprising:

(a) a frame;

(b) supply roll support means on the frame for supporting a supply roll for rotation on the frame;

(c) a pair of positively-driven primary draw rolls supported relative to the frame for removing the web from the supply roll, the primary draw rolls causing the supply roll to rotate as the web is drawn from the supply roll by the primary draw rolls;

(d) retarding means supported relative to the frame to resist rotation of said supply roll during withdrawal of the web of material from said supply roll by the primary draw rolls;

(e) a positively-driven center-rewind spindle onto which the web of material is rewound as a roll supported relative to the frame;

(f) a positively-driven conveyor supported relative to the frame for carrying said web from said primary draw rolls and for transferring said web onto said rewind spindle, said conveyor having a transfer drum and a positively-driven secondary draw roll for delivering the web of material from the primary draw rolls onto the transfer drum, said secondary draw roll in peripheral contact with the transfer drum to transfer the web from the secondary draw roll directly onto the transfer drum at the peripheral contact between the secondary draw roll and the transfer drum, and the transfer drum in peripheral contact with the roll of material wound onto said spindle so that the web of material is transferred directly from the transfer drum onto the roll of material wound on the spindle at the peripheral contact between the transfer drum and the roll of material; and (g) a control mechanism for controlling synchronous movement of said primary draw rolls and said spindle relative to said conveyor so that the web is carried by the conveyer from the primary draw roll to the center-rewind spindle with the web in flat surface contact with the transfer drum as the web is rewound onto the spindle.

30. A machine for rewinding a web of thin flexible material comprising:

(a) a frame providing at least a pair of linear slots;

(b) primary draw means supported relative to the frame for removing the web from said supply roll;

(c) a positively-driven center-rewind spindle onto which the web of material is rewound as a roll supported relative to the frame, said rewind spindle including a floating shaft mounted in the linear slots on said frame, said shaft being movable within said linear slots in a direction transverse to the axis of rotation of said spindle as the diameter of the roll of material on said spindle increases;

(d) a positively-driven conveyor supported relative to the frame for carrying said web from said primary draw means and for transferring said web onto said rewind spindle, said conveyor having a positively-driven transfer drum and a positively-driven secondary draw roll for delivering the web of material from the primary draw means onto the transfer drum, said secondary draw roll in peripheral contact with the transfer drum to transfer the web from the secondary draw roll directly onto the transfer drum at the peripheral contact between the secondary draw roll and the transfer drum, and the transfer drum in peripheral contact with the roll of material wound onto said spindle so that the web of material is transferred directly from the transfer drum onto the roll of material wound onto the spindle at the peripheral contact between the transfer drum and the roll of material; and (e) a control mechanism for controlling synchronous movement of said primary draw means and said spindle relative to said conveyor so that the web is carried by the conveyor from the primary draw means to the center-rewind spindle with the web in flat surface contact with the transfer drum as the web is rewound onto the spindle.

31. The machine as recited in claim 30 comprising locking means on the frame to prevent movement of said floating shaft within said slots at a predetermined position of the floating shaft within the slots.

32. A machine for rewinding a web of thin flexible material comprising:

(a) a frame;

(b) a pair of positively-driven primary draw rolls supported relative to the frame for removing the web from a supply roll;

(c) a positively-driven center-rewind spindle onto which the web of material is rewound as a roll supported relative to the frame;

(d) a positively-driven conveyor supported relative to the frame for carrying the web from said primary draw rolls and for transferring said web onto said rewind spindle, said conveyor having a positively-driven transfer drum with circumferential grooves and a positively-driven secondary draw roll supported relative to the frame intermediate the primary draw rolls and the transfer drum for delivering the web of material from the primary draw rolls to the transfer drum, wherein said secondary draw roll is in peripheral contact with the transfer drum at a contact point to transfer the web from the secondary draw roll directly onto the transfer drum at the contact point between the secondary draw roll and the transfer drum, the web of material maintaining continuous surface contact with the transfer drum from the contact point between the secondary draw roll and the transfer drum until the web is transferred to the roll of material wound onto the spindle, and wherein the transfer drum is in peripheral contact at a predetermined contact point with the roll of material wound onto said spindle so that the web of material is transferred directly at the predetermined contact point from the transfer drum onto the roll of material wound onto the spindle;

(e) slitting means supported relative to the frame proximate the contact point between said transfer drum and the roll of material wound onto said spindle, said slitting means coacting with the circumferential grooves in said transfer drum to slit the web while the web is contacting said transfer drum, the web of material maintaining continuous surface contact with said transfer drum until the web is transferred to the roll of material wound onto the spindle; and (f) a control mechanism for controlling synchronous movement of said primary draw rolls and said spindle relative to said transfer drum so that the web is carried by the transfer drum from the primary draw rolls to the center-rewind spindle with the web in flat surface contact with the transfer drum as the web is rewound onto the spindle.

33. The machine as recited in claim 32 wherein said transfer drum exerts a resistive drag on the roll of material wound onto said spindle to limit the velocity of said spindle relative to said conveyor.

34. The machine as recited in claim 33 wherein said control mechanism comprises a transmission which links and drives said primary draw rolls, said secondary draw roll, said spindle, and said transfer drum in synchronism.

* * * * *